US010919068B1

(12) United States Patent
Newmeyer

(10) Patent No.: US 10,919,068 B1
(45) Date of Patent: Feb. 16, 2021

(54) PROTECTIVE HOUSING ASSEMBLY FOR AN IN-GROUND POP UP SPRINKLER, AND A SYSTEM AND METHOD FOR INSTALLATION THEREOF

(71) Applicant: David Allen Newmeyer, Ocala, FL (US)

(72) Inventor: David Allen Newmeyer, Ocala, FL (US)

( * ) Notice: Subject to any disclaimer, the term of this patent is extended or adjusted under 35 U.S.C. 154(b) by 147 days.

(21) Appl. No.: 15/910,543

(22) Filed: Mar. 2, 2018

(51) Int. Cl.

| | |
|---|---|
| ***B05B 15/16*** | (2018.01) |
| ***B05B 15/622*** | (2018.01) |
| ***E02F 5/20*** | (2006.01) |
| ***B05B 15/74*** | (2018.01) |

(52) U.S. Cl.
CPC ..... *B05B 15/622* (2018.02); *B05B 15/16* (2018.02); *B05B 15/74* (2018.02); *E02F 5/20* (2013.01)

(58) Field of Classification Search
CPC ..... B05B 15/622; B05B 15/16; B05B 15/74; E02F 5/20
See application file for complete search history.

(56) References Cited

U.S. PATENT DOCUMENTS

| | | | | |
|---|---|---|---|---|
| 2,751,250 | A | | 6/1956 | Block |
| 3,015,448 | A | | 1/1962 | Hurless |
| 3,018,057 | A | | 1/1962 | Anderson |
| 3,265,310 | A | | 8/1966 | Cohen |
| 3,662,956 | A | | 5/1972 | Hedman |
| 3,762,642 | A | | 10/1973 | Di Santo |
| 3,904,120 | A | | 9/1975 | Sbicca |
| 4,108,439 | A | | 8/1978 | McGuire |
| 4,145,003 | A | | 3/1979 | Harrison et al. |
| 4,429,832 | A | | 2/1984 | Sheets |
| 4,582,256 | A | | 4/1986 | Jaquez |
| 4,781,327 | A | | 11/1988 | Lawson et al. |
| 4,784,325 | A | * | 11/1988 | Walker ..... B05B 15/74 239/204 |
| 5,037,030 | A | | 8/1991 | Apodaca |
| 5,102,048 | A | | 4/1992 | Bohnhoff |
| 5,213,262 | A | | 5/1993 | Violette |
| 5,772,118 | A | | 6/1998 | Fabiano |
| 5,931,385 | A | | 8/1999 | Miller |
| 5,938,121 | A | | 8/1999 | Ferguson et al. |
| 6,138,924 | A | * | 10/2000 | Hunter ..... B05B 15/16 239/204 |
| 6,186,416 | B1 | | 2/2001 | Jones |
| 6,543,704 | B2 | | 4/2003 | Stephens |

(Continued)

*Primary Examiner* — Qingzhang Zhou
(74) *Attorney, Agent, or Firm* — Glenn E. Gold, P.A.; Glenn E. Gold

(57) ABSTRACT

An improved protective housing assembly for a pop-up type in-ground sprinkler incorporates one or more spacer disks, configured for being seated beneath a sprinkler support housing body flange, extend(s) outwardly to effectively prevent grass and other ground cover from extending over the in-ground pop-up sprinkler. An optional unitary porous filter disk body may be provided sized, shaped and otherwise configured for being snugly received within the sprinkler support housing interior space, and includes a central opening for snugly receiving the sprinkler main body therethrough, such that the porous structure of the filter disk body enables passage of water therethrough while preventing passage of solid debris into the bottom of the sprinkler support housing body.

11 Claims, 9 Drawing Sheets

(56) References Cited

U.S. PATENT DOCUMENTS

| | | | |
|---|---|---|---|
| 6,764,025 | B1 | 7/2004 | Espina |
| 7,114,665 | B1 | 10/2006 | McTee |
| 7,617,994 | B2 | 11/2009 | Gunderson et al. |
| 7,717,360 | B1 | 5/2010 | Kander |
| 8,550,375 | B2 | 10/2013 | Curtis |
| 8,910,723 | B2 | 12/2014 | Orr et al. |
| 8,936,206 | B1 | 1/2015 | Wright |
| 9,149,825 | B1 | 10/2015 | Blakeslee et al. |
| 2001/0032890 | A1 | 10/2001 | Stephens |
| 2005/0023375 | A1 | 2/2005 | Tanczos |
| 2005/0284956 | A1 | 12/2005 | Mast |
| 2010/0127099 | A1 | 5/2010 | Memole |
| 2011/0198410 | A1 | 8/2011 | Curtis |

* cited by examiner

PROTECTIVE HOUSING ASSEMBLY FOR AN IN-GROUND POP UP SPRINKLER, AND A SYSTEM AND METHOD FOR INSTALLATION THEREOF

FIELD OF THE INVENTION

The present disclosure relates generally to automatic in-ground sprinkler systems and, more particularly, to a sprinkler protective housing assembly particularly configured for protecting installed pop-up rotary and spray type irrigation sprinkler heads from damage caused by inadvertent contact with lawn maintenance equipment, and for preventing surrounding grass/vegetation from impeding the functionality of such irrigation sprinklers.

BACKGROUND OF THE INVENTION

In-ground lawn sprinkling systems typically comprise a polyvinyl chloride (PVC) irrigation conduit system running beneath the ground surface and in fluid communication with in-ground sprinklers via suitable T-connectors and the like, such that the sprinkler water dispensing heads are located at or proximate to the ground surface. During typical operation sprinkler heads, such as spray-type heads and rotary type heads, are temporarily extended upwardly while irrigation water is being dispensed over, for example, an area of lawn and/or landscape vegetation. Even though such sprinkler heads conventionally retract it is common for at least an uppermost portion of the sprinkler (e.g. the sprinkler head) to remain exposed above the ground surface. One common issue with such pop-up type sprinklers is that their proper intended functionality is often impeded by the growth of surrounding vegetation. To ensure proper operation, it is crucial that the sprinkler head remains substantially free from undesirable interaction with grass, weeds and related vegetation growth. When such vegetation growth extends over even a portion of the sprinkler head, it may impede proper operation of the sprinkler. For instance, it is well known that overgrown vegetation commonly prevents proper pop-up action of the sprinkler. Furthermore, overgrown vegetation—even in instances where it does not impeded proper pop-up action of the sprinkler—will often still interact with the proper function of the sprinkler (e.g. by interacting with the water emitted from the sprinkler head and thereby negatively impacting the desired water flow, spray pattern and the like.

Unfortunately, exposed pop-up sprinkler heads remain highly susceptible to being covered by grass, weeds and the like growing over the top of the sprinkler head. Again, such overgrowth often interferes with the proper function of the sprinkler. For instance, grass overgrowth may impede the "pop-up" action that the sprinklers rely upon in order to properly dispense water over a desired ground area, or such growth proximate to (but not directly over) the sprinkler head nozzle may impede the desired irrigation water spray pattern emitted from the sprinkler head nozzle. As a result, areas of grass and vegetation may be under-watered and consequently die. Therefore, it would be highly desirable to provide a means for minimizing, and preferably preventing, surrounding grass and vegetation from growing over pop-up style sprinklers, as well as from growing too close to such sprinklers.

Furthermore, even in instances where such overgrowth has not yet impeded the sprinkler head pop-up functionality it often camouflages the sprinkler head, which makes it difficult, if not impossible, for an individual to see. This makes the sprinkler heads highly-susceptible to damage from lawn and landscaping maintenance equipment. For example, a sprinkler head may be inadvertently damaged by a landscape vehicle or struck by a lawnmower blade. Repairing or replacing a broken or faulty sprinkler head, sprinkler body, sprinkler water inlet and irrigation conduit connection, or the like, is often time consuming and expensive. Therefore, it would be highly desirable to provide a means for minimizing, and preferably preventing, damage to pop-up style sprinklers from inadvertent contact with lawn and landscaping maintenance equipment.

During installation of conventional pop-up sprinklers, a relatively large-sized cavity (substantially larger than the actual space required to receive the sprinkler body) is dug into the ground surface, a sprinkler water inlet (typically at the lower end of the pop-up sprinkler) is connected to the irrigation conduit system, and the cavity is back-filled with dirt or other ground fill materials, leaving an upper end portion, or head, of the sprinkler exposed while leaving the remaining body of the sprinkler completely buried beneath the ground surface. As stated above, since pop-up sprinklers are conventionally inserted directly into the ground in this manner, attempting to access an installed sprinkler (e.g. to replace the sprinkler, to make repairs to the sprinkler, etc.) is a cumbersome, time consuming and costly proposition. Furthermore, it is commonly necessary to completely reinstall or reposition such sprinklers when they are installed either too deep or too shallow in the ground. For example, in the event that a sprinkler is installed with the sprinkler head protruding above the ground surface it becomes highly susceptible to being damaged. Similarly, when such sprinklers are improperly installed/buried at an angle it often becomes necessary for sprinkler maintenance personnel to dig up the sprinkler to adjust the sprinkler body angle vis-à-vis the respective ground surface. Accordingly, it would be highly desirable to provide a means for installing such conventional pop-up type sprinklers that provides improved flexibility with regard to the adjustability of the height of sprinkler head vis-à-vis the ground surface, provides improved structural support for the sprinkler to ensure that the desired proper sprinkler orientation is maintained (i.e. avoiding undesirable lateral movement/displacement over time), and that enables an individual installer to prevent the growth of grass and other vegetation within a user-defined area surrounding the sprinkler head.

Over the years, numerous attempts have been made to protect in-ground pop-up type sprinkler heads from being damaged. For example, so-called sprinkler guards, such as those commonly referred to as "donuts," have been developed to surround the sprinkler head. Such sprinkler guards are designed to either sit atop the ground surface or partially buried in the ground surface. Such sprinkler guards attempt to provide some degree of protection for the sprinkler head by providing a visual indicator to lawn maintenance personnel of the presence of a sprinkler head. However, it is well known that such products are ineffective when it comes to protecting the sprinkler head from inadvertent contact with lawn maintenance equipment. Furthermore, such products do not impede undesirable growth of grass over and/or adjacent to the sprinkler head. Furthermore, such visual-type sprinkler guards are usually either free-standing or slightly inserted into the ground surface, and are thus highly susceptible to being dislodged and displaced, particularly when they are contacted by heavy lawn maintenance equipment and machinery.

In light of at least the aforementioned drawbacks, limitations and disadvantages associated with the use of existing in-ground pop-up sprinkler systems, there remains a long felt, but as of yet unmet, need in the irrigation and landscaping industry for an apparatus/device that addresses at least the aforementioned disadvantages, drawbacks and limitations associated with existing pop-up type devices. In particular, there is need for such an improved apparatus/device that will more adequately limit, and preferably prevent, sprinkler head damage from lawn maintenance and landscaping equipment, facilitate the maintenance of desired fixed orientation of such sprinklers during installation into the ground and following installation into the ground. It would be further desirable to provide such an apparatus that would provide an individual with the flexibility to adjust the height of the sprinkler head vis-à-vis the ground surface, as well as to define a ground surface area surrounding the sprinkler where the growth of grass or any other vegetation is not desired; thereby, preventing the interference of such surrounding growth with the function of the sprinkler. The present invention successfully addresses these and other issues associated with current in-ground pop-up type sprinklers.

SUMMARY OF THE INVENTION

The present disclosure is generally directed to an improved protective housing assembly for in-ground sprinklers (and particularly pop-up type in-ground sprinklers), a system/kit for installation of the protective housing assembly for use with a newly-installed pop-up type sprinkler or for use with a previously-installed pop-up type sprinkler, and a method of installation, which overcomes the aforementioned drawbacks, disadvantages and limitations of the prior art.

The improved protective housing assembly is particularly well-suited for use in connection with in-ground pop-up sprinklers including a main body extending from a sprinkler body upper end to a sprinkler body lower end, the sprinkler body upper end having a central opening extending therethrough, the sprinkler body lower end having a water inlet extending therethrough, and the in-ground sprinkler main body containing a vertically-translatable sprinkler riser (or similar pop-up type mechanism) having a water inlet at a lower end thereof and a water-emitting nozzle at an upper end thereof. In accordance with an exemplary implementation, the support housing assembly may include:

(a) A sprinkler protective support housing body having a contiguous sidewall extending upwardly from a periphery of a protective support housing base and terminating at an outwardly-extending peripheral flange at the upper end of the sprinkler protective support housing, the contiguous sidewall and base together defining a support housing interior space, the support housing base having a central opening extending completely therethrough, the support housing base central opening having a diameter nominally greater than a corresponding outer diameter of the sprinkler body, and the flanged upper end of the support housing contiguous sidewall defining an upper support housing opening;

(b) A sprinkler protective support housing cover having a peripheral edge and a central aperture extending completely therethrough, the sprinkler support housing cover sized, shaped and otherwise configured for being snugly seated proximate the sprinkler support housing upper end to facilitate selective covering of the upper support housing opening such that the support housing cover central aperture is in communication with the support housing interior space, the support housing cover central aperture having a diameter nominally greater than a corresponding outer diameter of said vertically-translatable water-emitting pop-up element of said sprinkler; and (c) A spacer disk having a unitary body defined by a peripheral edge, an upper surface and a lower surface, the spacer disk body having a thickness and including an opening extending completely therethrough, the spacer disk body opening having a diameter nominally greater than a corresponding outer diameter at the upper end of the sprinkler support housing for enabling slidable receipt of the sprinkler support housing base and sidewall therethrough, such that the spacer disk body can be seated about the upper end of the sprinkler support housing flush against a lower surface of the sprinkler support housing outwardly-extending peripheral flange, at least a portion of the spacer disk peripheral edge extending outwardly a distance beyond the periphery of the corresponding outwardly-extending sprinkler support housing peripheral flange, wherein, when the support housing assembly containing the in-ground sprinkler is installed in a ground surface the spacer disk is interposed between the underlying ground surface and the lower surface of the outwardly-extending peripheral flange of the sprinkler support housing to effectively raise the sprinkler support housing peripheral flange a distance above the ground surface.

In an aspect, the support housing assembly may further include a porous filter disk sized, shaped and otherwise configured for being snugly received within the sprinkler support housing interior space, the porous filter disk body having a central opening extending completely therethrough and sized, shaped and otherwise configured for being snugly received between an exterior surface of the sprinkler main body and an interior surface of the support housing sidewall, wherein the porous structure of the filter disk body effectively supports the sprinkler main body in a desired vertical orientation, and enables passage of water therethrough while preventing undesirable passage of solid debris therethrough.

In another aspect, the unitary spacer disk may have an annular geometry, a non-circular peripheral edge and/or a non-symmetric geometry. Furthermore, the spacer disk may be provided having a geometry wherein the spacer disk surrounds only a portion of the protective support housing periphery; particularly in instances where the sprinkler assembly is located directly adjacent to a fixed structure such as a driveway, patio, wall or other fixed structure.

In another aspect, the protective support housing itself may be provided molded in a variety of shapes and geometries to enable desired placement/positioning adjacent to a fixed structure such as a driveway, patio, wall and the like.

In another aspect, the protective support housing may be provided having one or more drainage apertures in its base and/or sidewall in order to facilitate the egress of water when the housing interior contains undesirable excessive water.

In another aspect, a plurality of stacked spacer disks may be employed interposed between the underlying ground surface and the lower surface of the outwardly-extending peripheral flange of the sprinkler support housing to enable a user to selectively vary the height of the protective support housing upper flange above the underlying ground surface.

In another aspect, the plurality of stacked spacer disks may be provided as a series of concentrically-stacked annular-shaped disks having varying disk body diameters in order to form an inwardly-stepped configuration to minimize sprinkler damage from contact with landscape equipment.

In another aspect, the spacer disks may be provided in the form of a planar spacer disk substrate containing frangible portions to enable a user to remove one or more of the frangible portions to form a desired spacer disk geometric form. For instance, a planar spacer disk substrate may be provided in the form of a series of concentric annular-shaped disks wherein adjacent annular-shaped disks are adjoined along frangible lines to enable an end user to detach one or more of the outer concentric disks to reduce the surface area, or footprint, of the spacer disk to a desired footprint. While it is preferable to use a solid spacer disk structure (i.e. without any frangible portions, to adequately withstand the force, or impact, from a vehicle or landscape equipment running over the sprinkler apparatus, it is still contemplated that spacer disks incorporating one or more frangible portions may be appropriate for particular applications where such force/impact is not a risk.

In another aspect, the protective support housing assembly may be used without any spacer disks. For example, spacer disks may not be employed where an end user desires a reduced foot print on their property. In such instances, the protective support housing, or main housing unit, will fully function offering the same benefits of protection (e.g. via the support housing flange) as well as reduced obstruction to the sprinkler head, albeit to a lesser degree than with the use of one or more spacer disks.

In another aspect, the unitary porous filter disk body may be seated against an interior surface of the base of the sprinkler support housing body or, alternatively, a distance above an interior surface of the sprinkler support housing base.

In another aspect, the unitary porous filter disk body may have a resilient compressible construction.

In another aspect, a support housing assembly kit may be provided for use installing a protective housing assembly for a pop-up type in-ground sprinkler, the sprinkler including a main body extending from a sprinkler body upper end to a sprinkler body lower end, the sprinkler body upper end defining an upper end opening and the sprinkler body lower end incorporating a water inlet extending therethrough, the in-ground sprinkler main body containing a vertically-translatable water-emitting pop-up element having a water inlet at a lower end thereof and a water-emitting nozzle at an upper end thereof, the support housing assembly kit including:

(a) A sprinkler support housing body having a contiguous sidewall extending upwardly from a periphery of a support housing base and terminating at an outwardly-extending peripheral flange at an upper end of the sprinkler support housing, the contiguous sidewall and base together defining a support housing interior space, the support housing base having a central opening extending completely therethrough, the support housing base central opening having a diameter nominally greater than a corresponding outer diameter of the sprinkler body, the flanged upper end of the support housing contiguous sidewall defining an upper support housing opening;

(b) A sprinkler support housing cover having a peripheral edge and a central aperture extending completely therethrough, the sprinkler support housing cover sized, shaped and otherwise configured for being snugly seated proximate the sprinkler support housing upper end to facilitate selective covering of the upper support housing opening such that the support housing cover central aperture is in communication with the support housing interior space, the support housing cover central aperture having a diameter nominally greater than a corresponding outer diameter of the vertically-translatable water-emitting pop-up element of the sprinkler. The housing cover, or lid, not only functions to reduce the ingress of debris into the protective support housing interior, but also minimizes the likelihood of an individual inadvertently tripping over an uncovered protective support housing unit. Consequently, the cover provides an additional safety function:

(c) A spacer disk having a unitary body defined by a peripheral edge, an upper surface and a lower surface, the spacer disk body having a thickness and including an opening extending completely therethrough, the spacer disk body opening having a diameter nominally greater than a corresponding outer diameter at the upper end of the sprinkler support housing for enabling receipt of the sprinkler support housing base and sidewall therethrough, such that the spacer disk body can be seated about the upper end of the sprinkler support housing flush against a lower surface of the sprinkler support housing outwardly-extending peripheral flange, at least a portion of the spacer disk peripheral edge extending outwardly a distance beyond the periphery of the corresponding outwardly-extending sprinkler support housing peripheral flange:

(d) A circular ground-excising tool including a main body defined by a contiguous sidewall extending downwardly from a ground-excising tool upper base and terminating at a lower peripheral saw-toothed cutting edge defining a lower opening, the ground-excising tool contiguous sidewall and base together defining a ground-excising tool main body interior space; and (e) A ground-excising tool manipulating device having a handle portion and a ground-excising tool engagement portion for enabling manual rotation of the tool to drive the tool downward through a ground surface surrounding the in-ground sprinkler.

In another aspect, the support housing assembly kit may further include a porous filter disk sized, shaped and otherwise configured for being snugly received within the sprinkler support housing interior space, the porous filter disk body having a central opening extending completely therethrough, the filter disk body central opening sized, shaped and otherwise configured for being snugly received between an exterior surface of said sprinkler main body and an interior surface of said support housing sidewall, wherein the porous structure of the filter disk body enables passage of water therethrough while preventing undesirable passage of solid debris therethrough, and wherein the engagement of the porous filter disk with the sprinkler body functions to maintain the sprinkler body in a desired vertical orientation.

In another aspect, the unitary spacer disk may have an annular geometry, a non-circular peripheral edge and/or a non-symmetric geometry. Furthermore, the spacer disk may be provided having a geometry wherein the spacer disk surrounds only a portion of the protective support housing periphery; particularly in instances where the sprinkler assembly is located directly adjacent to a fixed structure such as a driveway, patio, wall or other fixed structure.

In another aspect, the protective support housing itself may be provided molded in a variety of shapes and geometries to enable desired placement/positioning adjacent to a fixed structure such as a driveway, patio, wall and the like.

In another aspect, the protective support housing may be provided having one or more drainage apertures in its base and/or sidewall in order to facilitate the egress of water when the housing interior contains undesirable excessive water.

In a further aspect, the support housing assembly kit may further include a circular ground-excising tool incorporating a hub-and-spoke configuration made up of a plurality of spaced-apart cutting blades radiating outwardly from an annular central hub, the annular central hub having an inner diameter nominally greater than a corresponding exterior diameter of the pop-up sprinkler body, a proximal end of each cutting blade fixedly attached to the annular central hub and an opposite distal end of each cutting blade fixedly attached to an interior surface of the ground-excising tool contiguous sidewall, wherein the radial blades aid in the excising of ground material while directing the ground material into an interior of the circular ground excising tool to facilitate its removal. Preferably, the cutting blades are provided at a horizontally offset angle to facilitate the excavation of soil during rotation of the circular ground-excising tool.

In another aspect, for particular applications the kit may be provided absent any spacer disks. In that case, the flange portion of the protective support housing is provided directly engaging the underlying ground surface.

In another aspect of the invention, a method is provided for installing the sprinkler protective housing assembly about a pop-up type in-ground sprinkler, the in-ground sprinkler including a main body extending from a sprinkler body upper end to a sprinkler body lower end, the sprinkler body upper end defining an upper end opening and the sprinkler body lower end incorporating a water inlet extending therethrough, the in-ground sprinkler main body containing a vertically-translatable water-emitting pop-up element having a water inlet at a lower end thereof and a water-emitting nozzle at an upper end thereof, the method including steps of: (a) providing a sprinkler support housing body having a contiguous sidewall extending upwardly from a periphery of a support housing base and terminating at an outwardly-extending peripheral flange at the upper end of the sprinkler support housing, the contiguous sidewall and base together defining a support housing interior space, the support housing base having a central opening extending completely therethrough, the support housing base central opening having a diameter nominally greater than a corresponding outer diameter of at least a lower portion of the sprinkler body, the flanged upper end of the support housing contiguous sidewall defining an upper support housing opening;

(b) providing a sprinkler support housing cover having a peripheral edge and a central aperture extending completely therethrough, the sprinkler support housing cover sized, shaped and otherwise configured for being snugly seated proximate the sprinkler support housing upper end to facilitate selective covering of the upper support housing opening such that the support housing cover central aperture is in communication with the support housing interior space, the support housing cover central aperture having a diameter nominally greater than a corresponding outer diameter of the vertically-translatable water-emitting pop-up element of the sprinkler;

(c) providing a spacer disk having a unitary body defined by a peripheral edge, an upper surface and a lower surface, the spacer disk body having a thickness and including an opening extending completely therethrough, the spacer disk body opening having a diameter nominally greater than a corresponding outer diameter at the upper end of the sprinkler support housing for enabling slidable receipt of the sprinkler support housing base and sidewall therethrough, such that the spacer disk body can be seated about the upper end of the sprinkler support housing flush against a lower surface of the sprinkler support housing outwardly-extending peripheral flange, at least a portion of the spacer disk peripheral edge extending outwardly a distance beyond the periphery of the corresponding outwardly-extending sprinkler support housing peripheral flange;

(d) providing a porous filter disk sized, shaped and otherwise configured for being snugly received within the sprinkler support housing interior space, the porous filter disk body having a central opening extending completely therethrough, the filter disk body central opening sized, shaped and otherwise configured for being snugly received between an exterior surface of the sprinkler main body and an interior surface of the support housing sidewall, wherein the porous structure of the filter disk body enables passage of water therethrough while preventing undesirable passage of solid debris therethrough;

(e) providing a circular ground-excising tool including a main body defined by a contiguous sidewall extending downwardly from a ground-excising tool upper base and terminating at a lower peripheral saw-toothed cutting edge defining a lower opening, the ground-excising tool contiguous sidewall and base together defining a main body interior space, the ground-excising tool including a plurality of spaced-apart cutting blades radiating outwardly from an annular central hub, the annular central hub having an inner diameter nominally greater than a corresponding exterior diameter of the pop-up sprinkler body, a proximal end of each cutting blade fixedly attached to the annular central hub and an opposite distal end of each cutting blade fixedly attached to an interior surface of the ground-excising tool contiguous sidewall;

(f) providing a ground-excising tool manipulating device having a handle portion and a ground-excising tool engagement portion for enabling manual rotation of the tool to drive the tool downward through a ground surface surrounding said in-ground sprinkler;

(g) disposing the circular ground-excising tool over the head of said in-ground sprinkler such that the uppermost end of the sprinkler is received through the annular central hub of the tool;

(h) engaging the ground-excising manipulating tool with the ground-excising tool, and concurrently applying downward pressure and circular rotation of the ground-excising tool via the ground-excising tool manipulating device to excise ground material surrounding the in-ground sprinkler to thereby create an extended ground cavity about the sprinkler body;

(i) seating the annular porous filter body within the sprinkler support housing body such that the porous filter body is snugly retained between the interior surface of the support housing body sidewall and the exterior surface of the sprinkler main body;

(j) inserting the sprinkler main body into the sprinkler support housing body until a bottom end of the sprinkler main body is received through both the porous filter disk central aperture and the sprinkler support housing central aperture;

(k) sliding the spacer disk about the sprinkler support housing body until the spacer disk is flush against the lower surface of the support housing body flange lower surface;

(l) confirming that the sprinkler body water inlet is attached to connecting structure of an irrigation system water source such that the sprinkler body water inlet is in fluid communication with the irrigation system water source;

(m) seating the sprinkler support housing into the extended ground cavity until the spacer disk is interposed between the ground surface and the support housing body flange lower surface; and (n) seating the sprinkler support housing assembly cover over the opening in the upper surface of the sprinkler support housing.

In an aspect, the step of providing a spacer disk may further comprise providing a spacer disk having, in lieu of an aperture, a periphery having a recessed portion sized, shaped and otherwise configured to enable the support housing main body 22 to be laterally received within the recessed portion of the spacer disk instead of requiring insertion of the support housing main body through a spacer disk aperture.

In another aspect of the method, the aforementioned optional variations pertaining to the structure and composition of the protective support housing body and cover, the porous filter disk, and the ground excising tool may be employed.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF EXEMPLARY IMPLEMENTATIONS

Figure 1:
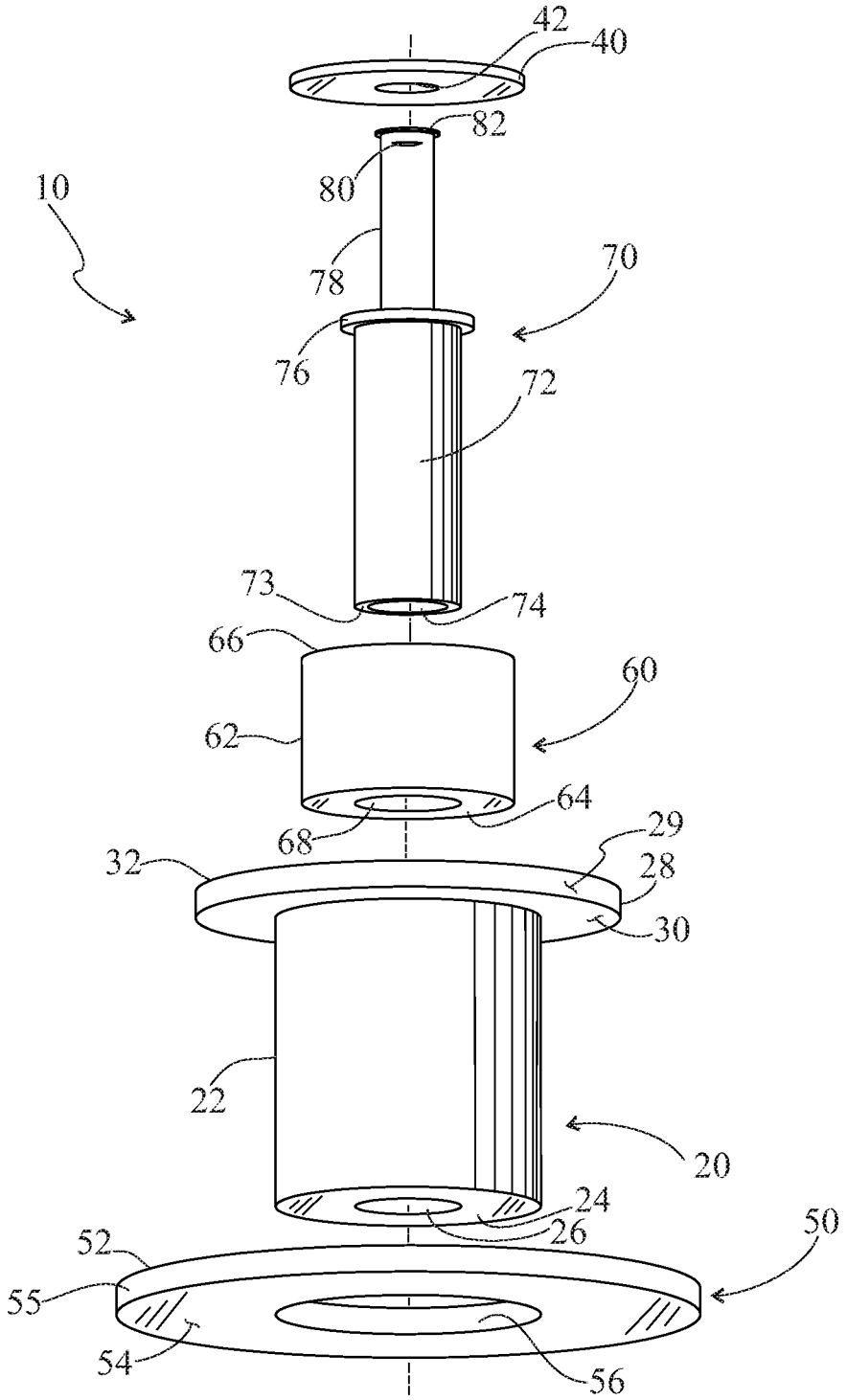
FIG. 1 presents an exploded perspective view of an improved in-ground sprinkler and support housing assembly in accordance with an exemplary implementation of the invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring initially to FIGS. 1-5, in accordance with a first exemplary implementation, a protective housing assembly for an in-ground sprinkler is shown generally as reference numeral 10. The protective housing assembly 10 is particularly adapted for use with conventional pop-up sprinklers such as that shown as reference numeral 70. Pop-up sprinklers are well known in the irrigation and sprinkler arts and typically include a main body 72 having a water inlet 74 extending through a lower surface 73 and threaded or otherwise adapted for attachment to a conventional irrigation conduit end or conduit connector (not shown). At its upper end, the main body 72 may have a flange 76 (as shown) or, alternatively, a threaded reinforced cover or the like, which are generally greater in diameter than the corresponding main body 72. The upper end of the sprinkler main body 72 has an opening 35 enabling unimpeded vertical translation of riser 78 (or any similar pop-up structure) therethrough. At its upper end, riser 78 includes a nozzle 80 that may support a water radius spray-pattern adjustment screw 82. At its lower end, riser 78 includes a riser water inlet 84.

At a lower end/surface 73, the sprinkler body 72 typically incorporates a threaded water inlet 74 that is adapted to be interconnected to an external water supply via a threaded water irrigation connector (not shown). Additional conventional elements of various conventional pop-up style in-ground sprinklers may include a body cap, wiper seal and the like, which are not shown in the accompanying drawing figures as they do not represent patentable features of the invention, are well-known to those skilled in the sprinkler and irrigation arts, and are therefore not necessary to render the invention enabled. As will be apparent to those skilled in the art, various internal workings of such sprinkles, including, for example, springs, check valves, pressure activated stem cleaners, water lubricated drive mechanisms, flow adjusters and the like are not necessary to enable a complete understanding of the present invention. However, some examples of the inner workings of exemplary conventional pop-up sprinklers may be found in U.S. Pat. Nos. 4,625,914; 4,787,558; and 6,732,950 (all assigned to Rain Bird Sprinkler Manufacturing Corporation of Glendora, Calif.), the entire contents of which are incorporated-by-reference herein. A few representative non-limiting examples of commercially-available pop-up type sprinklers with which the present invention could be employed include RAIN BIRD brand models 1800 Professional Series Full Pattern 4 inch Pop-up Sprinkler; F4-PC Falcon 6504 Series Part Circle Rotor Pop-up Sprinkler; 1804H Half Circle Pop-Up Sprinkler; and SP25AP-25 Sure Pop Pop-Up Adjustable Pattern Sprinkler.

Figures 2, 3:
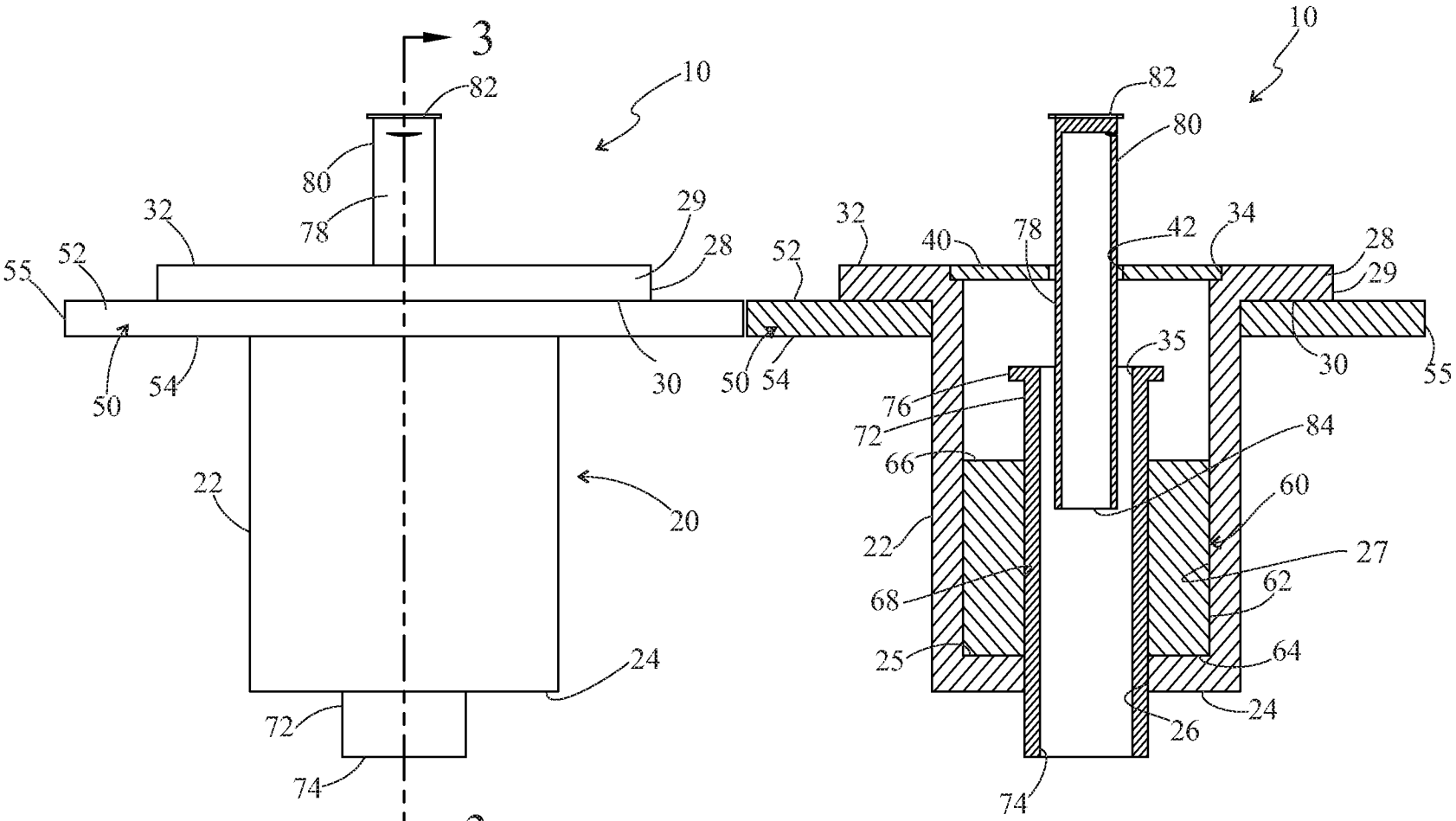
FIG. 2 presents a side elevation view of the improved in-ground sprinkler and support housing assembly of FIG. 1 shown in a fully assembled state.
FIG. 3 presents a cross-sectional view taken along section line 3-3 of FIG. 2.
Figure 5:
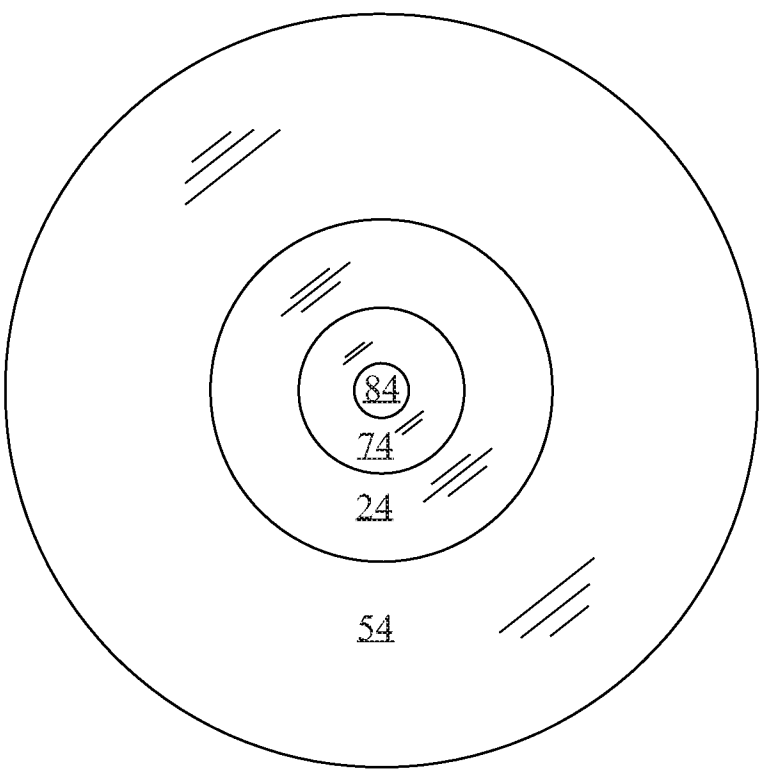
FIG. 5 presents a bottom plan view of the fully assembled improved in-ground sprinkler and support housing assembly of FIG. 2.
Figure 4:
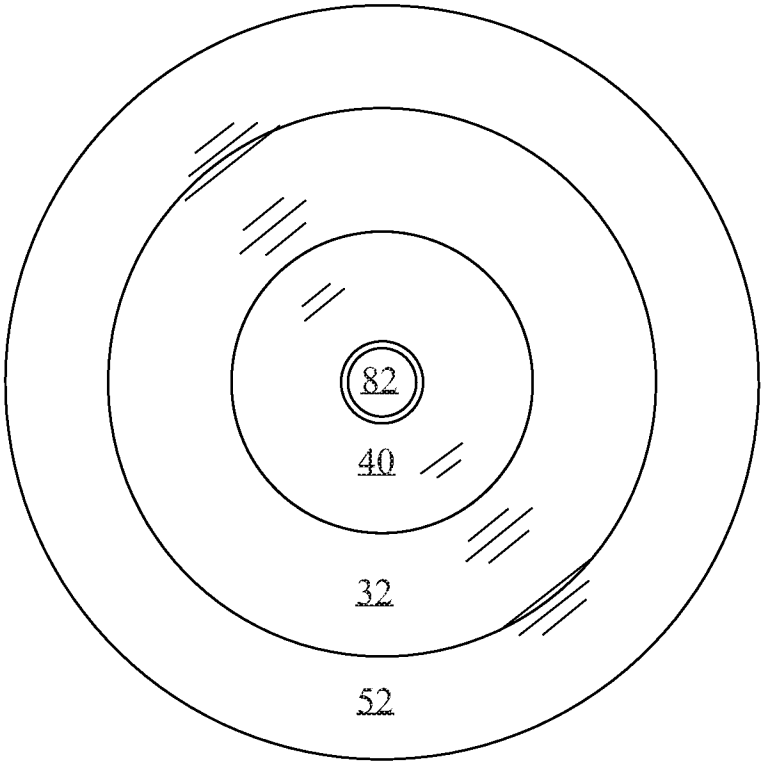
FIG. 4 presents a top plan view of the fully-assembled improved in-ground sprinkler and support housing assembly of FIG. 2.

Representative pop-up sprinkler 70 is housed, or seated, within a sprinkler protective support housing 20 having a main body portion 22 including a base 24 incorporating a central aperture 26 for receiving a lower portion of sprinkler main body 72 therethrough for subsequent direct or indirect connection to an irrigation water supply line (not shown). A significant function of the support housing main body portion 22 is to minimize undesirable lateral movement/translation of the supported sprinkler 70 following installation. At its upper end, sprinkler support housing 20 has an integral outwardly-extending flange 28 defined by a peripheral flange edge 29, a lower flange surface 30 and an upper flange surface 32. A significant function of the flange 28 is to set and subsequently maintain a desired height of the supported sprinkler vis-à-vis the surrounding ground surface. A sprinkler support housing cover 40 is provided having a configuration for being snugly seated over an upper opening 34 of sprinkler support housing main body 22. As best shown in FIG. 3, for example, upper opening 34 may be provided in the form of a recessed shoulder for securely supporting cover 40 and preventing lateral movement thereof. However, the invention is not intended to be so limiting. As will be apparent to those skilled in the art, any available configuration of upper opening 34 that enables effective releasable attachment of cover 40 over opening 34 is contemplated for use with the present invention. Cover 40 is provided having a central aperture 42 for facilitating unimpeded vertical translation of riser 78 (including nozzle 80 and radius adjustment screw 82) therethrough. In particular, it is preferable that the diameter of aperture 42 of cover 40 is nominally greater than the corresponding diameters of riser 70, nozzle 80 and spray pattern control screw 82 (or nominally greater than any alternative structure at the upper end of the pop-up subassembly of any other pop-up type sprinkler used with the present invention) to enable unimpeded vertical translation (i.e. extension and retraction) of the upper end of the pop-up structure through aperture 42. With that said, it is preferable that the clearance between the upper portion of the pop-up structure and the sidewall of the aperture 42 is limited to minimize the ingress of undesirable debris and the like into the interior cavity/space of support housing 20.

Significantly, the present invention incorporates a porous filter disk body 60 sized, shaped, and otherwise configured for being seated within an interior space of sprinkler support housing body 22. The filter disk 60 has a geometry that is preferably in the form of a cylindrical annular body defined by sidewall exterior surface 62, lower annular surface 64, upper annular surface 66, and central aperture 68; alternatively referred to as a cylindrical channel. However, as will be apparent to those skilled in the art, the invention is not intended to be so limiting. For instance, filter body disk 60 may be provided in a variety of alternative geometries, as long as the filter disk body can be snugly inserted into the interior space of sprinkler support housing 20 such that sprinkler body 72 is snugly received through filter disk central aperture 68, and the exterior surface 62 of filter body 60 is snugly engaged against the sidewall interior surface 27 of sprinkler support housing 20. In that manner, the filter disk body enables desirable filtration, or passage of water therethrough while impeding the passage of dirt, debris and other undesirable solid particles into at least a lower portion of the interior space of sprinkler support housing 20. Furthermore, the snug fit between the sprinkler body exterior and the filter disk central aperture 68 provides a further function of retaining the entire sprinkler in a substantially vertical orientation.

Depending upon the material construction of filter body 60, it may further function to trap such undesirable particulates within the porous filter disk body media. Furthermore, depending upon the porous media type, filter body 60 may be intended to be cleaned and reused or, alternatively, disposed of and replaced. Generally speaking, filtration is the passing of water through a porous media. Filtration removes particles including, but not limited to, clays and silts, natural organic matter, stones, small particles of sand, grass and roots, rust, algae, and microorganisms. The degree of removal is a function of the filtering media. Thus, the choice of filter medium depends upon the cleanliness (i.e. quality) of the passing water and the filtering speed. Course, medium and/or fine porous media may be used depending upon the particulate matter desired to be filtered out. The choice of filter porous media is not intended to be limited. Any porous media that can be provided having the desired form factor (e.g. annular disk) is contemplated for use. Thus, any desired filter material that has the capability of filtering out dirt particles and other debris can be used. One good example is plural folded fiberglass pads and another might be polymer fibers of other types such as polyethylene, nylon, etc.

Although it is still possible for some limited volume of undesirable debris to enter the interior of support housing 20 (e.g. through central aperture 42 of cover 40), porous filter disk 60 functions to prevent the passage of such debris into the interior of support housing 20, and an individual can easily remove the filter disk 60 along with any undesirable trapped debris. Removal of filter disk 60 also functions to facilitate user access to the sprinkler 70 and, generally, any structure contained within the interior of the support housing 20. It is preferable that the interior space, or volume, between the exterior surface of the sprinkler body 72 and the interior surface 27 of the support housing main body 22 is adequate to enable insertion of an individual's hand therein to comfortably manipulate the sprinkler. Again, the filter disk body 60 may be constructed from any available material having a porous structure that enables the passage of irrigation and rain water therethrough while impeding the passage of undesirable solids, chemicals and the like. For example, the filter disk body may have a polymeric construction, a ceramic construction, a metallic construction or any other material construction that is not susceptible to degradation from exposure to water and other elements.

A significant drawback pertaining to the use of conventional pop-up in-ground sprinkler systems directly installed in the ground is that grass, weeds, and other vegetation commonly grow over the top of the sprinkler, or sprinkler head, and interfere with the proper function of the pop-up riser or other pop-up mechanism. Furthermore, excessive vertical growth of such vegetation proximate to the sprinkler, even if it does not grow over the sprinkler head, may interfere with a desired water spray pattern emitted from nozzle 80. As previously mentioned, support housing flange 28 primarily functions to maintain a desired supported sprinkler height by preventing protective support housing 20 from sinking into the ground. An additional benefit of support housing flange 28 is that it precludes the growth of vegetation around the sprinkler from the ground surface covered by the flange. As will be apparent to those skilled in the art, the geometry and surface area of support housing flange 28 may be preselected to prevent such undesirable growth within a predefined surrounding ground surface area.

The present invention further addresses this common drawback through the incorporation of one or more rigid spacer disks 50, each preferably having a planar annular geometry, and defined by upper surface 52, lower surface 54, and central opening 56, alternatively referred to as a central aperture. Although the rigid spacer disks are depicted in the drawing figures as having the preferred annular geometry, the invention is not intended to be so limiting. In fact, the spacer disks 50 may incorporate any shape/geometry desired for a particular application. For instance, when using a spacer disk 50 with a sprinkler that is in close proximity to a driveway, wall, fence or other structure, it may be desirable to tailor the shape, or geometry, of the spacer disk to facilitate its use in a location having a limited ground surface area surrounding a portion of the sprinkler 70 (and support housing 20). As will be apparent to those skilled in the art, although the spacer disks described herein and depicted in the accompanying drawings reference a spacer disk aperture, the spacer disk may alternatively be provided having a periphery including a recessed edge portion sized, shaped and otherwise configured to enable the support housing main body 22 to be snugly laterally received within the recessed portion of the spacer disk instead of requiring insertion of the support housing main body through a spacer disk aperture.

Figure 11:
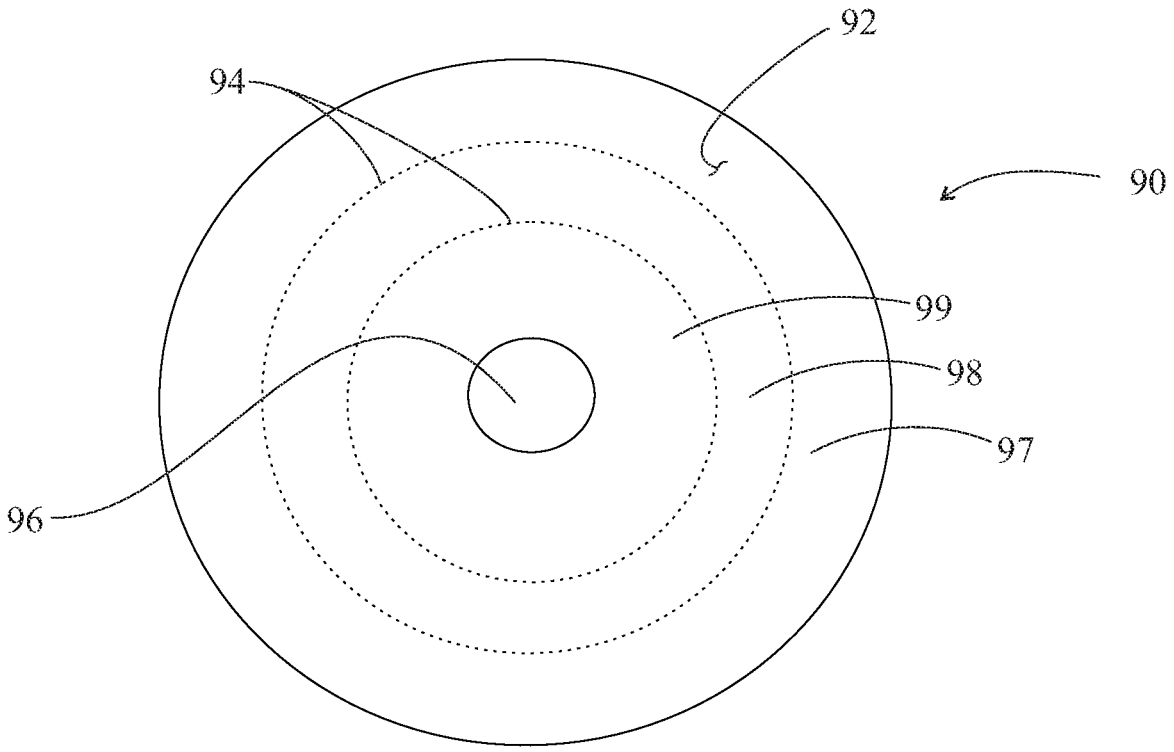
FIG. 11 presents a top plan view of an alternate exemplary implementation of spacer disks having a concentric frangible annular disk configuration for enabling an end user to alter the outer diameter of the spacer disk.

Furthermore, where annular-shaped spacer disks are employed it is contemplated to optionally provide spacer disks having one or more score lines or similar weakened interconnections to enable a user to selectively detach portions of the spacer disk to redefine its surface shape and area. For instance, this may include providing a unitary annular spacer disk having radial score lines to enable removal of one more segments of the annular spacer disk such that the spacer disk surrounds only a portion of the support housing 20. Furthermore, with regard to the use of circular (360-degree) annular spacer disks, frangible regions may be provided in order to enable variable spacer disk outer diameters. For example, referring now briefly to FIG. 11, a unitary spacer disk 90 having upper surface 92, central aperture 96, and outer peripheral edge 95 may be provided having a series of spaced-apart concentric frangible regions 94 adjoining outer annular portion 97, inner annular portion 99, and a central annular portion 98. In this manner, the spacer disk 90 may be used as is or, alternatively, outer annular portion 97 (and, optionally, central annular portion 98) may be removed via the aforementioned frangible regions 94 to create a reduced-diameter annular spacer disk. Thus, the circular frangible regions 94 are all concentric about a single common central aperture 96 to enable an end user with the option to select from a variety of reduced outer diameter spacer disks through removal of one or more outer annular portions 97, 98 separated by adjoining frangible portions 94.

Figure 12:
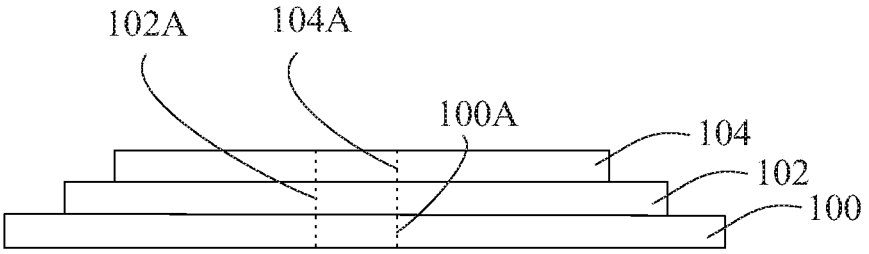
FIG. 12 presents a side elevation view of a plurality of variable diameter stacked concentric spacer disks in accordance with an exemplary implementation of the present invention.

In addition to limiting surrounding ground vegetation growth, a primary function of spacer disks 50 is to provide a user with a flexible and efficient means for adjusting the height of the supported sprinkler relative to the ground surface. The spacer disks 50 may be provided having a variety of thicknesses, to enable an end user to choose a thickness in accordance with a particular application. Furthermore, for some applications it may be desirable for an individual to use two or more spacer disks stacked upon one another in order to raise the vertical position of the supported sprinkler support housing 20 (and thus the respective sprinkler head). For example, referring briefly to FIG. 12, an exemplary stacked spacer disk configuration is shown wherein a first (lowermost) annular spacer disk 100 having a first outer diameter has stacked thereupon a second annular spacer disk 102 having a second diameter less than the first outer diameter and, in turn, the second annular spacer disk 102 has stacked thereupon a third annular spacer disk 104 having a third outer diameter less than the second outer diameter. In the stacked configuration as shown, the first, second and third annular spacer disks, 100, 102, and 104, respectively, each have respective corresponding equal diameter concentric central apertures 100A, 102A and 103A. In this exemplary stacked configuration, the decreasing diameters of the stacked spacer disks 100, 102, 104 form a stepped structure that functions to reduce the likelihood of damage to the protective housing assembly 10 when run over by a landscape maintenance vehicle or equipment.

Finally, it is contemplated to provide spacer disks having a variety of available colors in order to better blend into a surrounding landscape, or to identify a corresponding characteristic of a particular spacer disk. Furthermore, for particular applications it is contemplated to eliminate the incorporation of a spacer disk altogether. For example, this may be desirable for applications where a particular sprinkler is located in an area (e.g. directly adjacent to a fixed structure such as a driveway, patio, wall and the like) where the fixed structure impedes the use of a spacer disk and/or where the risk of damage to the sprinkler from being run over by a vehicle or equipment is minimal.

Referring now particularly to FIGS. 2 and 3, the protective housing assembly 10 (and corresponding pop-up in-ground sprinkler 70) is shown in a fully-assembled state. When installed in the ground (not shown), a spacer disk 50 is positioned, or located, interposed between a ground surface (or atop a patch of grass growing out of an underlying ground surface) and the lower surface 30 of flange 28 of sprinkler support housing 20. Significantly, the area of spacer disk 50 preferably extends beyond the peripheral edge 29 of sprinkler protective support housing 20. In this manner, the spacer disk functions to prevent, or at least significantly impede, the growth of grass, weeds and the like over, or adjacent to, the support housing cover 40, sprinkler riser nozzle 80 and/or radius adjustment screw 82. With that said, for particular applications it is contemplated to either avoid the use of a spacer disk altogether or to use one or more spacer disks that do not extend beyond the peripheral edge 29 of sprinkler protective support housing 20. For instance, for some applications a user may utilize a support housing flange 28 having a surface area adequate to prevent undesirable ground growth proximate to the sprinkler head, and having a thickness adequate to maintain a desired sprinkler height.

Figure 6:
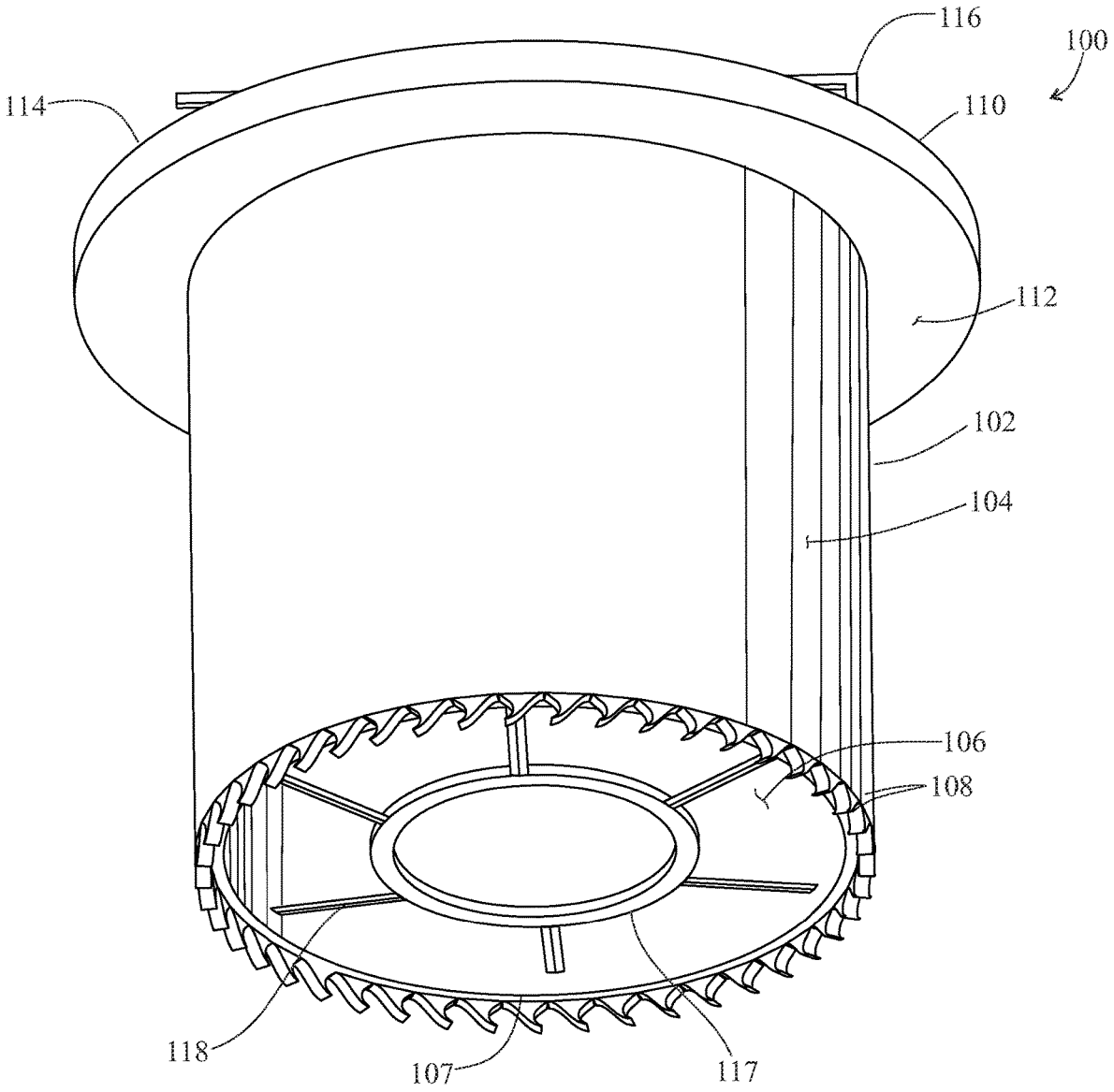
FIG. 6 presents a bottom isometric view of a ground cutting tool used to prepare a ground surface for receipt of the improved in-ground sprinkler and support housing assembly of the present invention.
Figure 7:
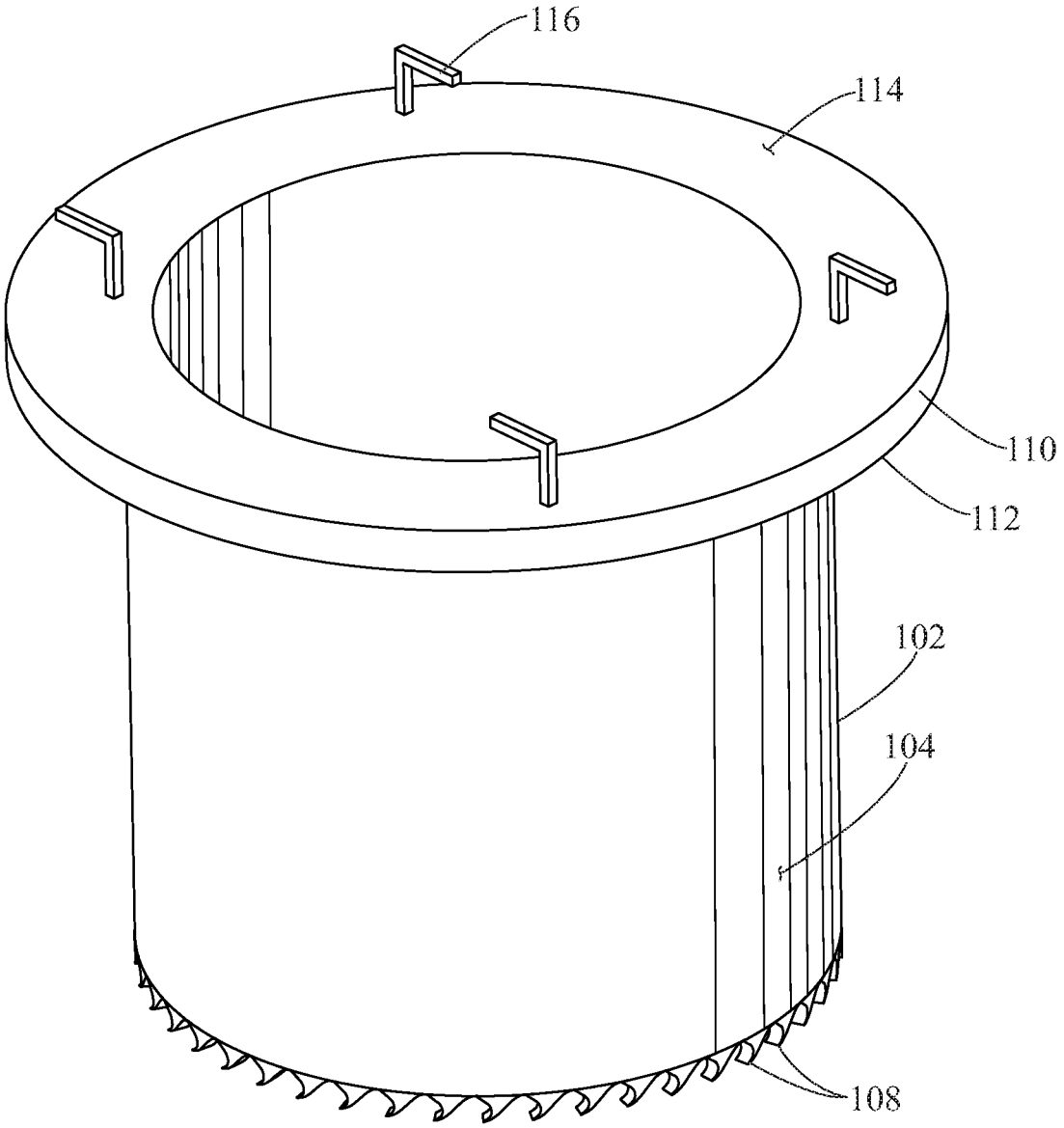
FIG. 7 presents a top isometric view of the ground cutting tool introduced in FIG. 6.

Referring now particularly to FIGS. 6-7, the present invention may further incorporate a circular cutting tool 100 particularly configured to enable an individual to create a uniformly-sized cavity in a ground surface for receiving a sprinkler protective support housing 20, either during a new sprinkler installation or surrounding an existing installed in-ground sprinkler. In the latter instance, the cutting tool 100 may be used to re-size an existing in-ground sprinkler cavity to retrofit the existing in-ground sprinkler with the protective housing assembly 10, and particularly sprinkler protective support main housing unit 20. Cutting tool 100 is preferably defined by a main body 102 including a cylindrical sidewall defining an interior space/cavity 107. The sidewall is defined by an exterior surface 104, an interior surface 106, and a lower edge in the form of a series of cutting teeth 108. A top side of the cutting tool 100 extends outwardly beyond the exterior surface 104 of the main body 102 to define an upper cutting tool flange 110 having a lower surface 112 and an upper surface 114. Significantly, the vertical position/location of the lower surface 112 of flange 110 ensures that the cutting tool is adapted to repeatedly create a cylindrical ground cavity having a precise desired depth and diameter. Preferably, a wheel-and-spoke type cutting mechanism is provided to both facilitate the creation of the desired cavity and to substantial contain the excised/removed volume of ground material within the interior of the cylindrical main body 102. In particular, a central ring 117 is provided defining a ring opening, and a series of spaced-apart ground cutting blades 118 are provided extending radially outward from the ring, with each cutting blade fixedly attached to the central ring 117 at a proximal end and fixedly attached to the interior surface 106 of the cutting tool main body 102 at a distal end. Preferably, cutting blades 118 are provided having a horizontally-offset angle to facilitate the process of excising the underlying ground material. Alternatively, the cutting blades 118 may be provided having an arcuate, or curved, geometry wherein a lower lateral blade edge is provided for directly engaging the ground material during use. One or more engagement elements 116, the function of which is described hereinbelow, are provided projecting from upper surface 114.

Figure 8:
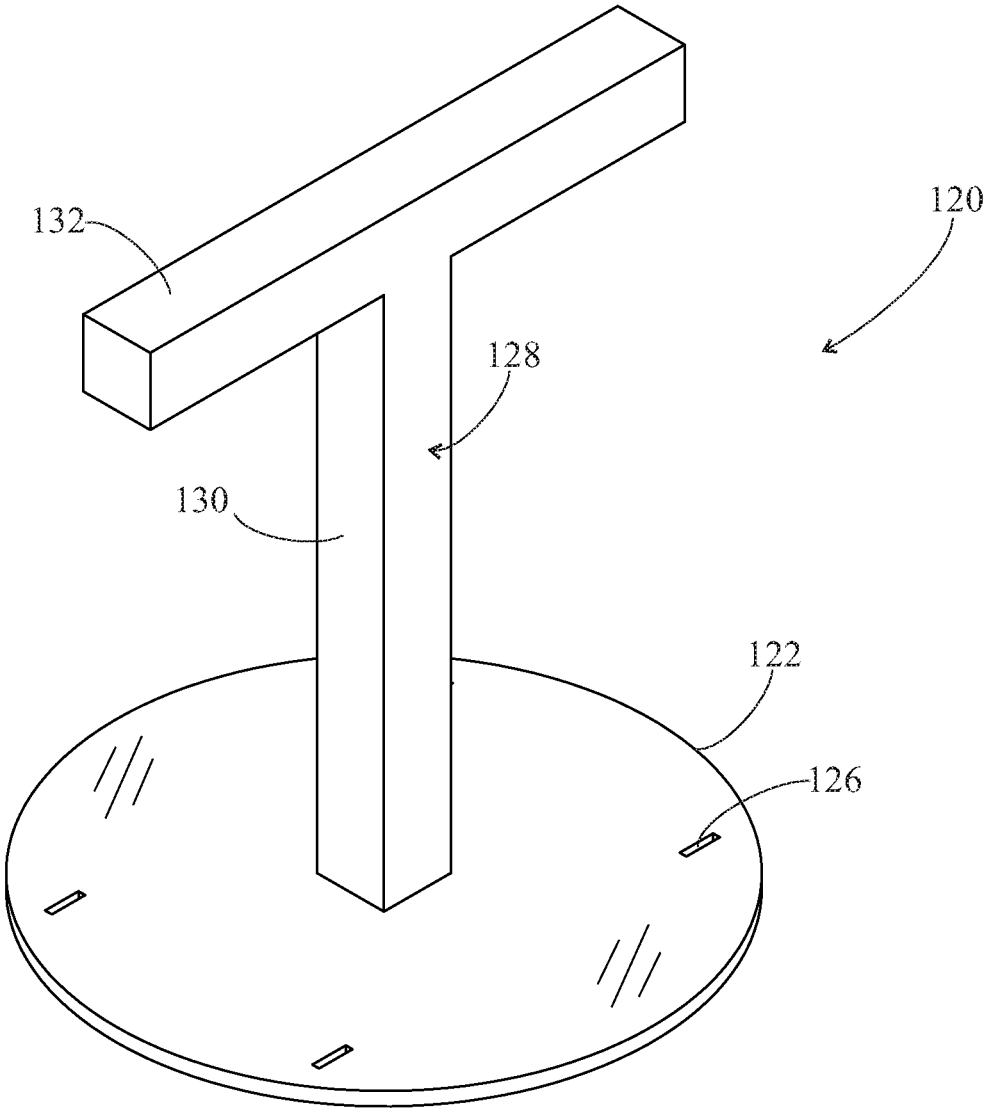
FIG. 8 presents a top-left isometric view of a first exemplary implementation of a cutting tool engagement device for rotational manipulation of the ground cutting tool introduced in FIG. 6.
Figure 9:
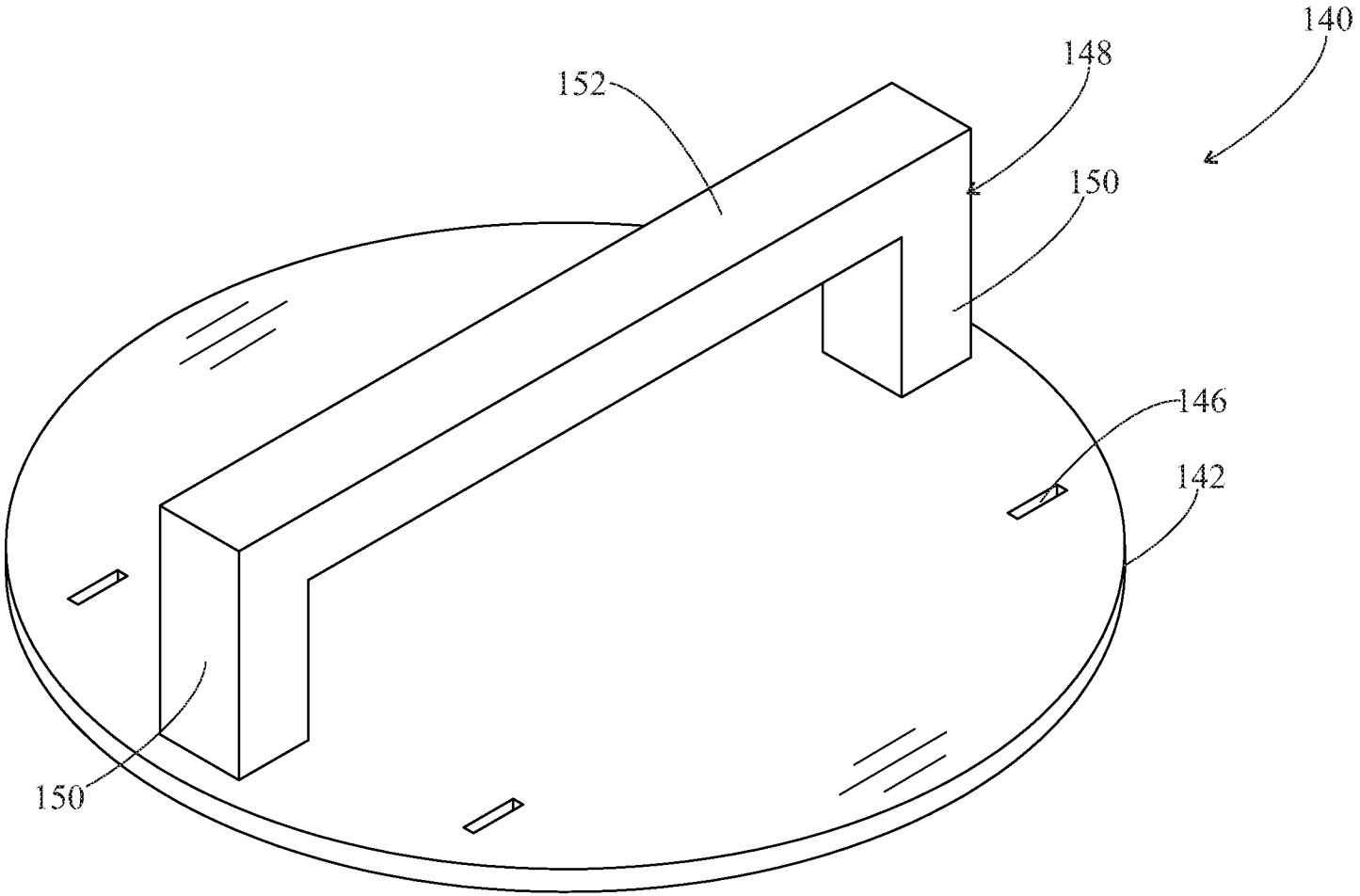
FIG. 9 presents a top-left isometric view of a second exemplary implementation of a cutting tool engagement device for rotational manipulation of the ground cutting tool introduced in FIG. 6.

Referring now particularly to FIG. 8, a circle cutting tool engagement device 120 is provided for enabling a user to manually rotate circle cutting tool 100 in order to create the aforementioned desired cylindrical ground cavity. Device 120 includes a planar base plate 122 having a series of spaced apart slots/aperture 126 extending therethrough, which are sized and shaped to for releasable selective engagement with elements 116 on upper surface 114 of cutting tool 100. A T-shaped handle 128 having a vertical member 130 and a horizontal member 132, extends upwardly from the top of planar base plate 122 to enable a user to rotatably engage cutting tool 100 in order to create a desired ground cavity. Referring now to FIG. 9, in an alternative configuration a circle cutting tool engagement device 140 may be defined by planar base plate 142, apertures 146 and handle 148 defined by vertical members 150 and horizontal member 152.

Figure 10:
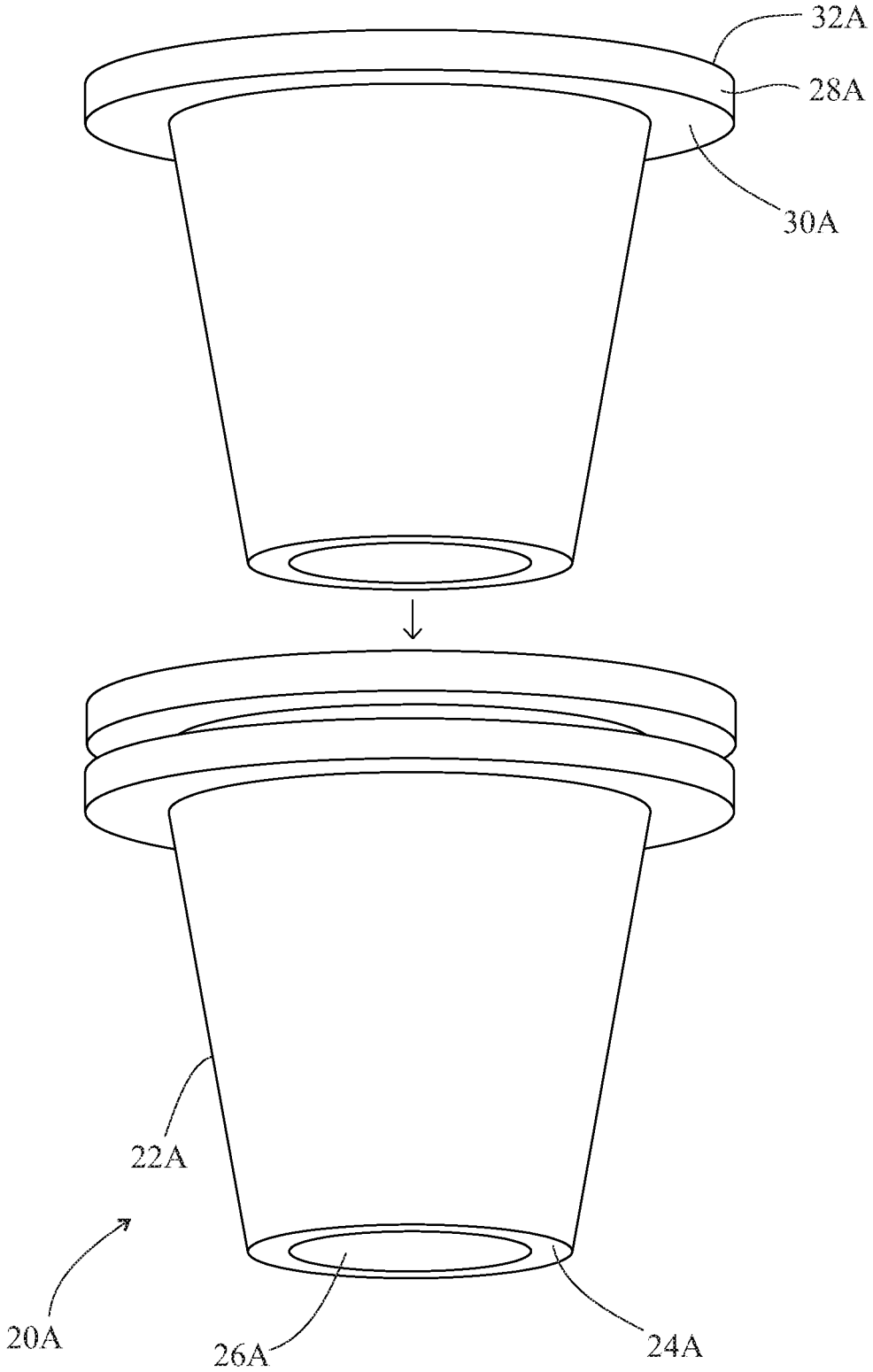
FIG. 10 presents an isometric view of an alternate exemplary implementation of a sprinkler support housing structure having a nestable structure.

Referring now particularly to FIG. 10, in an alternative implementation the support housing portion of the protective housing assembly may be fabricated to enable nesting of multiple support housings to facilitate efficient packaging, shipping and store shelf display. For example, in the exemplary implementation of FIG. 10, support housing 20A is provided having a tapered main body exterior surface 22A extending between base 24A (having central aperture 26A) and upper end flange 28A having lower flange surface 30A and upper flange surface 32A.

The protective housing assembly 10 of the present invention overcomes the aforementioned drawbacks, disadvantages and limitations of conventionally installed pop-up type sprinklers by both protecting installed sprinklers from damage caused by landscape equipment/vehicles and preventing interference with sprinkler functionality from surrounding grass, vegetation and the like. The main body portion 22 of the protective support housing 20 effectively limits lateral movement of the supported sprinkler 70, while the outwardly-extending flange 28 effectively maintains a desired height of the supported sprinkler. The spacer disks 50 enable user-desired adjustability of the height of the main protective housing unit 20 (and supported sprinkler 70) with respect to the ground surface, while also enabling user-desired control of ground growth adjacent to the protective housing 20 and supported sprinkler 70. As previously noted, in some circumstances, this same benefit may be achieved by the protective housing unit 20 and cover 24 without the use of spacer disks 50. However, for the majority of applications the spacer disks 50 are a key component of the present invention because they enable an end user to customize the protective housing assembly 10 via user-defined height and width adjustment.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence. By way of example, it is contemplated to incorporate a wheel or roller subassembly, or the like, either along a lower edge of the main panel body and/or panel corner supports in order to provide means for rolling the assembly along a ground surface rather than carrying the assembly.

What is claimed is:

1. A support housing assembly for a pop-up type in-ground sprinkler, the pop-up type in-ground sprinkler including a body extending from a pop-up type in-ground sprinkler body upper end to a Pop-up type in-ground sprinkler body lower end, the pop-up type in-ground sprinkler body upper end defining an upper end opening and the pop-up type in-ground sprinkler body lower end incorporating a water inlet extending therethrough, the pop-up type in-ground sprinkler body containing a vertically-translatable water-emitting pop-up element having a water inlet at a lower end thereof and a water-emitting nozzle at an upper end thereof, the support housing assembly for the pop-up type in-ground sprinkler comprising:

a support housing body having a contiguous sidewall extending upwardly from a periphery of a support housing base, and terminating at an outwardly-extending radial flange at the upper end of the support housing body, the contiguous sidewall and the support housing base, together, defining a support housing interior space, the support housing base having a central opening extending completely therethrough, the support housing base central opening sized and shaped to enable passage of the pop-up type in-around sprinkler body lower end completely therethrough the outwardly-extending radial flange at the upper end of the support housing body contiguous sidewall defining a support housing body upper end opening;

a support housing cover bounded by a peripheral edge and having a central aperture extending completely through the support housing cover, the support housing cover sized and shaped for being seated proximate the sprinkler support housing upper end to facilitate selective covering of the upper support housing body opening such that the support housing cover central aperture is in communication with the support housing interior space, the support housing cover central aperture enabling passage of said vertically-translatable water-emitting pop-up element therethrough; and a spacer disk defined by a peripheral edge, a planar upper surface and a planar lower surface, the spacer disk having a thickness and including an opening extending completely therethrough, the spacer disk opening sized and shaped to facilitate slidable passage of the base and the contiguous sidewall of the support housing body therethrough, such that, in a fully assembled state, the spacer disk at least partially circumscribes the upper end of the support housing body, the planar upper surface of the spacer disk is positioned flush against a lower surface of the support housing body outwardly-extending radial flange, and at least a portion of the spacer disk peripheral edge extends radially outward a distance beyond the Peripheral edge of the corresponding outwardly-extending support housing body radial flange, wherein, when said support housing assembly containing said pop-up type in-ground sprinkler is installed in a ground surface, the spacer disk is interposed between the underlying ground surface and the lower surface of the outwardly-extending radial flange of the support housing body to raise the support housing body radial flange a distance above the ground surface corresponding to the thickness of the spacer disk.

2. A support housing assembly for a pop-up type in-ground sprinkler as recited in claim 1, the support housing assembly further comprising a porous filter disk sized and shaped for being seated within said support housing body interior space, the porous filter disk having a central opening extending completely therethrough that is sized and shaped for being seated between an exterior surface of said pop-up type in-ground sprinkler body and an interior surface of said support housing body contiguous sidewall, wherein a porous structure of said filter disk enables passage of water therethrough while impeding undesirable passage of solid debris therethrough.

3. A support housing assembly for a pop-up type in-ground sprinkler as recited in claim 1, wherein said spacer disk has an annular geometry.

4. A support housing assembly for a pop-up type in-ground sprinkler as recited in claim 1, wherein said spacer disk has a non-circular peripheral edge.

5. A support housing assembly for a pop-up type in-ground sprinkler as recited in claim 1, wherein said spacer disk has a non-symmetric geometry.

6. A support housing assembly for a pop-up type in-ground sprinkler as recited in claim 1, wherein said spacer disk further comprises a plurality of stacked spacer disks interposed between the underlying ground surface and the lower surface of the outwardly-extending radial flange of the support housing body.

7. A support housing assembly for a pop-up type in-ground sprinkler as recited in claim 6, wherein said plurality of stacked spacer disks further comprises a series of vertically-stacked and concentrically-arranged annular-shaped spacer disks.

8. A support housing assembly for a pop-up type in-ground sprinkler as recited in claim 2, wherein said porous filter disk is seated against an interior surface of the base of said support housing body.

9. A support housing assembly for a pop-up type in-ground sprinkler as recited in claim 2, wherein said porous filter disk is seated within the support housing body interior space a distance above an interior surface of the base of said support housing body.

10. A support housing assembly for a pop-up type in-ground sprinkler as recited in claim 2, wherein said porous filter disk has a resilient compressible structure.

11. A support housing assembly for a pop-up type in-ground sprinkler as recited in claim 1, wherein said spacer disk further comprises a first, innermost, annular-shaped spacer disk having a first spacer disk outer diameter and a concentric surrounding second annular-shaped spacer disk having a second spacer disk outer diameter greater than the first spacer disk outer diameter, the first and second spacer disks having a contiguous structure interconnecting the first and second spacer disks along a frangible adjoining region.

* * * * *